United States Patent [19]

Minera

[11] Patent Number: 4,524,408

[45] Date of Patent: Jun. 18, 1985

[54] CANDLE HOLDER COMBINATION

[76] Inventor: Salvador A. Minera, 1921 Taraval, San Francisco, Calif.

[21] Appl. No.: 622,962

[22] Filed: Jun. 21, 1984

[51] Int. Cl.[3] ..... F21L 19/00

[52] U.S. Cl. ..... 362/163; 431/290; 431/291; 431/288

[58] Field of Search ..... 362/161–163; 431/289, 290, 291

[56] References Cited

U.S. PATENT DOCUMENTS

| | | | |
|---|---|---|---|
| 416,418 | 12/1889 | Nessle . | |
| 663,833 | 12/1890 | MacIvy . | |
| 760,156 | 10/1903 | Schifferle . | |
| 3,240,035 | 5/1965 | Anderson | 67/27 |

FOREIGN PATENT DOCUMENTS

| | | | |
|---|---|---|---|
| 159951 | 3/1921 | United Kingdom | 431/290 |

*Primary Examiner*—Carroll B. Dority, Jr.
*Attorney, Agent, or Firm*—Robert W. Dilts

[57] ABSTRACT

An improved combination for use in burning an elongated candle floating in water. The improved combination comprises a float member including a passageway at least one inch long dimensioned to receive the cross-section of the candle with a sliding fit. Various structures for stabilizing the float member in the water with the passageway in a substantially vertical position and the upper end thereof at the surface of the water are disclosed. Containers of water of limited volume for use in the improved combination are described. Float members including chimneys and a preferred candle structure for use in the improved combination are described.

22 Claims, 9 Drawing Figures

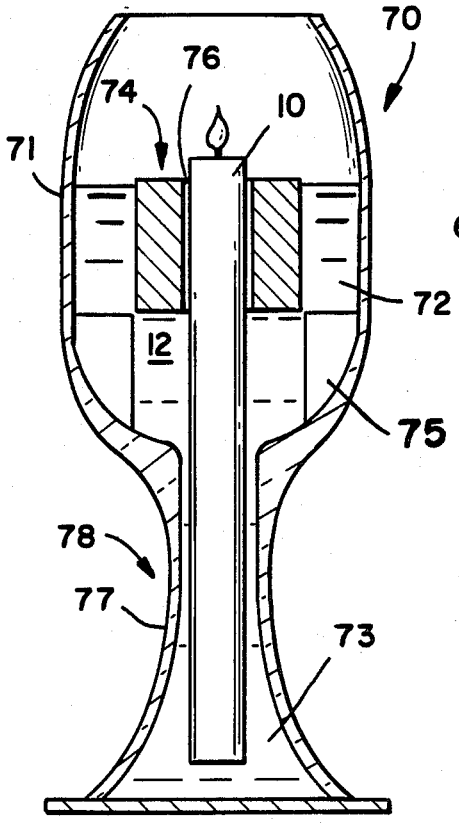
FIG _ 7
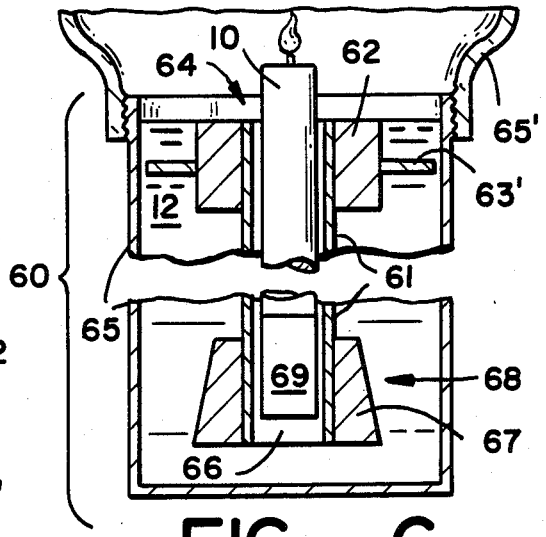
FIG _ 6
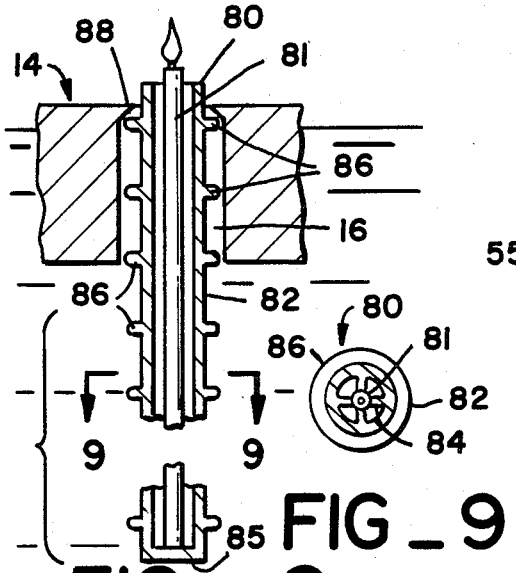
FIG _ 9
FIG _ 8
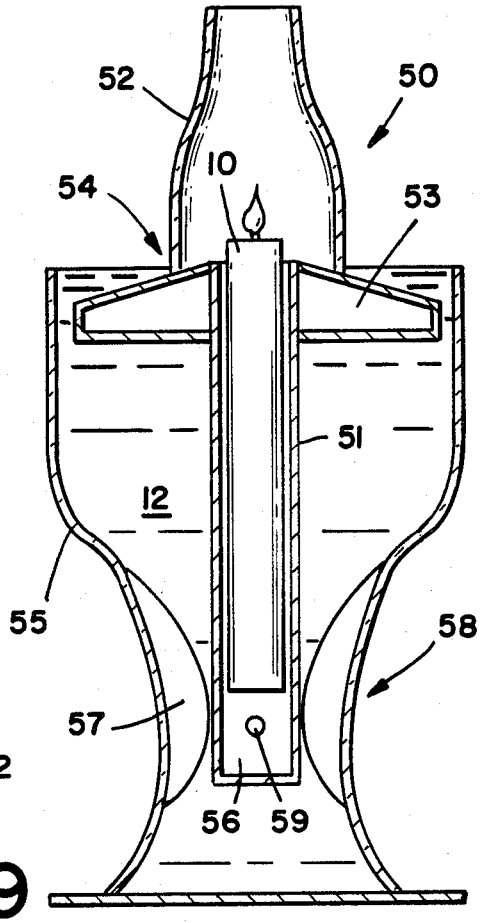
FIG _ 5

CANDLE HOLDER COMBINATION

BACKGROUND OF THE INVENTION

1. Field of the Invention

This invention relates to a candle holder combination of the type in which the candle is supported by water, burning and floating to the surface thereof as it burns, and more particularly to an improved candle and holder combination of the above type capable of self-adjustment independently of the volume of water with which it is used.

2. Background Art

It is known in the prior art to support burning candles of very short axial length either directly on the surface, or above the surface on containers which are capable of floating on the surface, of a body of water, such as a swimming pool for example. However, the useful life of such candles is limited because they must have a very short axial length relative to their cross-sectional dimensions in order to be stable enough to avoid tipping over.

Burning candles of any substantial length could only be floated in relatively small containers of water according to the prior art, where the containers are dimensioned to either restrain the candles against tipping over or to support a guide means capable of restraining the candles against tipping over. Thus, according to the teaching of U.S. Pat. No. 3,240,035 issued Mar. 15, 1966 to A. S. Anderson, a burning candle of substantial axial length is received with a sliding fit in an open ended cylindrical guide member. The guide member is made of high density material with foraminous walls and one end thereof is supported on the bottom of a container of water with the other end thereof at the surface of the water in the container.

However, the volume of the container is limited, by practical considerations, to a volume which is a small multiple of the volume of the candle. Thus, as the candle burns reducing the volume of the candle in the water, the water level in the container will drop below the upper end of the guide member. Since the burning end of the candle is only slightly above the water level, the flame of the candle will tend to be received within the guide member as the candle is consumed so that it will either be extinguished or the light thereof obstructed by the guide member.

Thus, it was found necessary very early in the prior art to provide a separate reservoir of water and means for conducting water therefrom to the container on demand in order to compensate for the decreasing volume of the candle as it burns. U.S. Pat. No. 416,418, issued to Nessle in 1889 and U.S. Pat. No. 663,833, issued to MacIvy in 1900 are representative of this teaching of the prior art.

U.S. Pat. No. 766,156, issued to Schifferle in 1904 teaches a different means of compensating for the loss of volume of the candle as it burns while supported by water in a container of limited volume. According to Schifferle, a float having lower density than the candle is submerged in the water beneath the candle and a stop is provided at the upper end of the container so that the candle is captured between the float and the stop. Thus, substantially all of the buoyancy in the system may be provided by the float and in a container of limited volume the float can be maintained in a substantially submerged condition by the stop at the upper end of the container as the volume of the candle is consumed.

SUMMARY OF THE INVENTION

The improved combination according to this invention for holding a floating candle of substantial axial length includes a float means including a passageway at least about one inch long dimensioned to receive the maximum cross-sectional dimensions of the candle with a close sliding fit and a container of water which may be of any size so long as it is dimensioned to freely receive the assembled float means and candle. A stabilizing means is provided beneath the surface of the water in the container for maintaining the passageway defined by the float means in a substantially vertical position when said candle is received therein.

SPECIAL DESCRIPTION OF THE DRAWING

This invention will be more fully understood from a reading of the following detailed description of preferred embodiments in conjunction with the appended drawing wherein:

FIG. 5 is a cross-sectional view of an embodiment of this invention including a container of water of limited size.

FIG. 6 is a cross-sectional view of another embodiment of this invention including a container of water of limited size.

FIG. 7 is a cross-sectional view of a further embodiment of this invention including a container of water of limited size.

FIG. 8 is a fragmentary cross-sectional view of a specific candle structure in combination with a modified float means according to yet another embodiment of this invention.

FIG. 9 is a cross-sectional view taken along line 9—9 of FIG. 8.

DETAILED DESCRIPTION OF PREFERRED EMBODIMENTS

Figure 1:
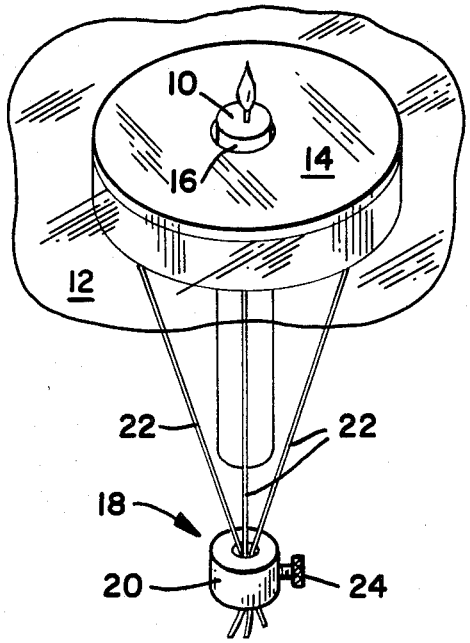
FIG. 1 is a perspective view of a first embodiment of this invention including a container of water of indeterminate size and illustrating the essential features of applicant's combination.
Figure 2:
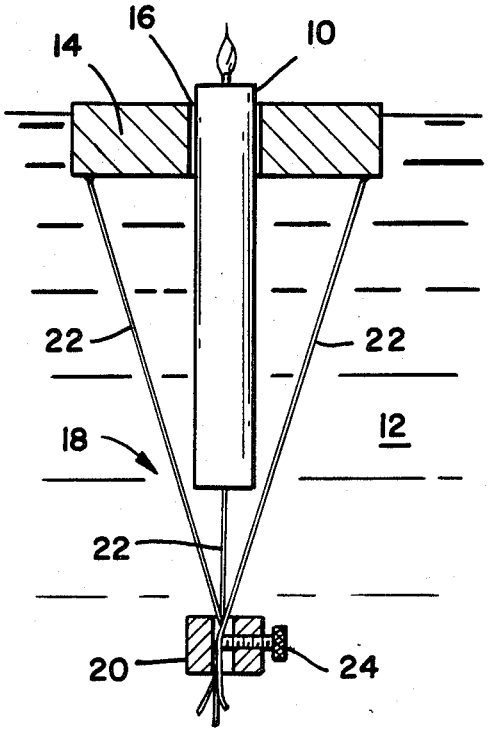
FIG. 2 is a cross-sectional view of the embodiment of FIG. 1.

Referring to FIGS. 1 and 2, an elongated candle 10 is shown floating in a body of water 12. As is well known in the art, candle wax has a specific gravity less than unity and thus the candle 10 will float at the surface of the water 12. However, due to its shape the elongated axis of the candle 10 will be unstable in any position other than the horizontal.

According to this invention, the axis of elongation of the candle 10 is maintained in a vertical position in the water by a float means 14. The float means 14 includes a passageway 16 dimensioned to receive the cross-section of the candle 10 with a close sliding fit. It has been found that the tolerance required between the exterior surface of the candle 10 and the interior surface of the passageway 16 to insure a sliding fit is such that the passageway 16 must have an axial length of at least about one inch in order to insure that the candle 10 will not bind in the passageway 16 as the candle 10 burns and the lower portion thereof rises upwardly through the passageway 16.

Although the float means 14 shown in FIGS. 1 and 2 of the drawing is in the form of a flat circular disc, it is noted that the shape of the float means 14 is unimportant according to the teaching of this invention. It is only necessary that the axis of the passageway 16 be stable in a vertical position with the upper end thereof at the surface of the water. To this end, according to the teaching of this invention, a means 18 for stabilizing the axis of the passageway 16 in a vertical position is provided beneath the surface of the body of water 12. According to the embodiment of this invention shown in FIGS. 1 and 2, the stabilizing means 18 comprises a weight 20 having a specific gravity substantially greater than unity attached to the float means 14 symmetrically of the axis of the passageway 16. For example, the weight 20 may be attached to the float means 14 by means of three or more rigid or flexible connecting elements 22 of equal length. For example, the connecting elements 22 may comprise lengths of flexible line having one of their ends attached to the float 14 symmetrically with respect to the axis of the passageway 16 and the other ends thereof received in an opening in the weight 20 and affixed thereto by means of a thumb screw 24, for example, to facilitate the equalization of the length thereof between the weight 20 and float means 14.

It will be understood that the portion of the candle 10 which projects below the float 14 will tend to contribute a certain instability to the vertical position of the axis of the passageway 16. The stabilizing means 18 will counteract such instability. The stabilizing means 18 is of particular importance when the candle 10 is to be supported in a large container of water such as a swimming pool or a lake, for example. This is due to the fact that float means 14 at the surface of the water of such a large container will be subjected to wave forces.

According to this invention, a candle 10 of considerable length may be caused to burn steadily at the surface of a large body of water. Thus a source of light having a life of many hours may be provided for decorative or other purposes at the surface of a large body of water. The float means 14 may, of course, be anchored to the bottom of the body of water by extending one of the flexible connecting elements 22 to an appropriate weight, post or other anchoring means, for example.

The float means 14 may be a solid body 26 made of cork, wood or other water insoluble material having a specific gravity less than unity. However, the float means 14 may also comprise a hollow body of high density material such as glass, plastic, or metal adapted to capture or hold a sufficient quantity of air to provide the required buoyancy.

Figure 3:
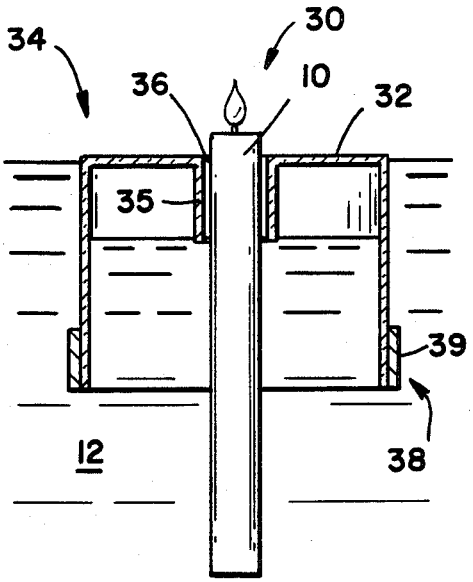
FIG. 3 is a cross-sectional view of another embodiment of this invention including a container of water of indeterminate size.

Thus, as shown in FIG. 3, the embodiment 30 of this invention comprises an inverted cup 32 providing the float means 34 of this invention. The bottom of the inverted cup 32 is apertured and a reentrant tubular member 35 is sealed about such aperture to provide a passageway 36 dimensioned to receive the cross-section of an elongated candle 10 with a close sliding fit. The length of the tubular member 35 and the dimensions of the cup 32 are selected so that the air trapped at the bottom of the inverted cup 32 about the tubular member 35 will provide the buoyancy required according to the teaching of this invention. The tubular member 35 must have an axial length of at least one inch for the reasons set forth hereinabove. According to the embodiment 30 of this invention as shown in FIG. 3, a stabilizing means 38 is provided by the rim of the inverted cup 32 beneath the surface of the water 12. In addition, a metal ring 39 of substantial weight may be attached to the rim of the cup 32 to enhance the stabilizing means. Thus an elongated candle 10 received in the passageway 36 will be supported by the water 12 with its axis of elongation maintained in a substantially vertical position by the float means 34 and stabilizing means 38.

Figure 4:
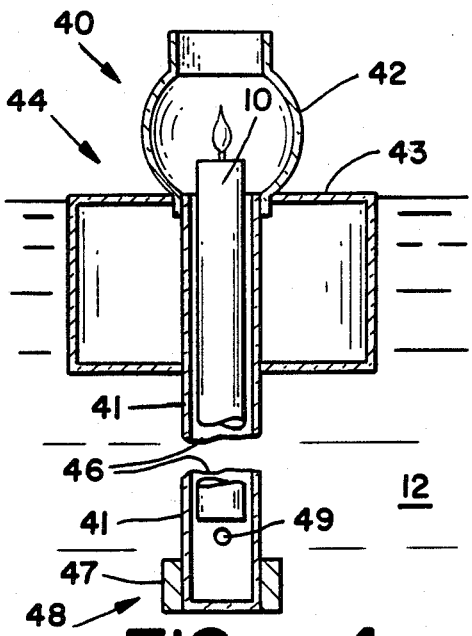
FIG. 4 is a cross-sectional view of a further embodiment of this invention including a container of water of indeterminate size.

Referring to FIG. 4, a preferred embodiment 40 of this invention for holding an elongated candle 10 in a body of water 12 of indeterminate size is shown. According to the embodiment 40, an extended tubular member 41 having a transparent chimney member 42 mounted on one end thereof and a hollow annular air-filled structure 43 affixed thereto adjacent the chimney structure 42 comprises the float means 44 according to this invention. The tubular member 41 provides a passageway 46 dimensioned to receive the maximum cross-sectional dimensions of the candle 10 with a close sliding fit and the extension thereof beneath the annular air-filled structure 43 provides a stabilizing means 48. A heavy metal collar 47 may be mounted on the opposite end of the tubular member 41 from the chimney member 42 to improve the means 48 for stabilizing the axis of the passageway 46 provided by the tubular member 41 in a vertical position when the float means 44 is placed in a body of water 12.

The candle 10 may be inserted in the float means 44 through the open top of the chimney member 42. However, it may be necessary to release the candle 10 after it is partly received within the passageway 46 provided by the tubular member 41. Under such circumstances, the inertia of the candle may cause the upper end thereof to descend into the tubular member 41 far enough to allow the wick at the upper end of the candle to become wet. If the lower end of the tubular member 41 is open so that the candle may project therefrom it will be particularly likely that the above described wetting of the wick will occur. Thus in the embodiment 40 the lower end of the tubular member is closed and a small hole 49 is provided through the side wall of the tubular member 41 to require water to be forced from the passageway 46 through the hole 49 thereby slowing insertion of the candle 10. It has been found that the provision of the restricted hole 49 will prevent the wetting of the wick of the candle without detracting from the gradual reentry of water required to float the candle upwardly in the passageway 46 as the candle burns.

The chimney member 42 will protect the flame of a burning candle received in the float means 44 from splashing water as well as from gusts of wind. It will be noted that the candle 10 as shown in FIG. 4 projects higher above the surface of the water 12 than in FIGS. 1 through 3. This is accomplished through the use of a candle 10 having an internal structure providing reduced specific gravity which may be of the commercially available type known as "dripless" candles. Such "dripless" candles have a plurality of longitudinally extending openings therethrough providing a honeycomb type cross-section. According to this invention, the lower end of such a "dripless" candle is sealed so that the candle will float in the water 12 without the water penetrating into the longitudinal openings therethrough.

Referring to FIG. 5, an embodiment 50 of this invention similar to the embodiment 40 but adapted for use in a container of water 12 of limited size is shown. Thus an extended tubular member 51 having a transparent chimney member 52 mounted at one end thereof and a hollow annular air-filled member 53 of air-impervious material mounted on the tubular member 51 adjacent the chimney member 52 comprises the float means 54. The container 55 of water 12 must have a cross-section dimensioned to freely receive the float means 54 and must have a depth greater than the length of the extended tubular member 51 of the float means 54 to be received therein. The tubular member 51 provides a stabilizing means 58 as well as an elongated passageway 56 dimensioned to receive the maximum cross-sectional dimensions of the candle 10 with a close sliding fit as described hereinabove and the length of the candle 10 to be received therein preferably has a length approaching the length of the tubular member 51.

According to the embodiment 50 of this invention, the interior surface of the container 55 may be provided with inwardly projecting ribs 57 spaced from each other to receive the lower end of the tubular member 51 centrally of the container 55 and thus cooperate with the stabilizing means 58 to center the candle in the container and maintain the axis of the passageway 56 in a substantially vertical position. As discussed hereinabove in connection with the embodiment 40, the lower end of tubular member 51 is preferably closed and a restricted hole 49 provided through the side wall of the tubular member 51 in order to facilitate the insertion of a candle 10 into the float means 54 in the container 55 of water 12 without wetting the wick thereof.

According to this invention, the flame of the candle 10 as it is burned will maintain a constant position within the transparent chimney 52 of the float means 54. Thus as the candle burns and its volume is consumed, the surface of the water 12 in the container 55 will be lowered and the float means 54 will be lowered within the container 55 regardless of its volume and the relative position of the flame of the candle 10 within the chimney 52 of the float means 54 will remain constant even though the position of the flame of the candle 10 relative to the container 55 is changed.

Referring to FIG. 6, an embodiment 60 of this invention is shown in which the relative position of the flame of the candle 10 will tend to remain constant with respect to a container of water 12 of limited size regardless of the water level therein. Thus an extended tubular member 61 having an annular body 62 of low specific gravity affixed about one end thereof, with an appropriate spacer ring 63 comprises the float means 64 of the embodiment 60. The spacer ring 63 is dimensioned to contact the inner surface of the side wall of a generally cylindrical cup or container 65 of water 12. The tubular member 61 provides a passageway 66 dimensioned to receive the cross-sectional dimensions of a candle 10. The length of the tubular member 61 is greater than the length of the candle 10 to be received therein and the depth of the container 65 is sufficiently greater than the length of the tubular member 61 so that the float means 64 will float freely therein at all times subject only to being centered in the container by the spacer ring 63. A heavy collar 67 of metal or other appropriate material is affixed to the tubular member 61 at the bottom end thereof to enhance the effect of the extended tubular member 61 in providing a stabilizing means 68 for maintaining the axis of the tubular member 61 in a substantially vertical position.

According to the embodiment 60 of this invention, an auxiliary float 69 having a specific gravity substantially less than the specific gravity of the candle 10 is received in the tubular member 61 beneath the candle 10. Thus, the auxiliary float member 69 will tend to support the candle 10 at a higher level with respect to the surface of the water 12 than the specific gravity of the candle 10 would normally produce. Furthermore, as the volume of the candle 10 is consumed and the water level in the container 65 falls, the auxiliary float member 69 will tend to support the burning end of the candle 10 at an ever increasing level with respect to the surface of the water 12 and the float means 64. Thus the position of the flame of the candle 10 will tend to remain constant with respect to the container 65.

As shown in FIG. 6, a transparent chimney 65' may be removably mounted on the upper end of the container 65. Due to the action of the auxiliary float means 69 as described above, the flame of the candle 10 will tend to be positioned within the chimney member 65' at a constant point throughout the consumption thereof by burning. Such position can, of course, only be precisely maintained by proper selection of the ratio of the volume of the container 65 to the volume of the candle 10 to that of the auxiliary float member 69. However, even though such ratios are not carefully selected, the flame of the candle 10 will be maintained in a relatively narrow positional range with respect to the chimney member 65'.

Referring to FIG. 7, an embodiment of this invention 70 is shown which includes a container 71 of water including a larger upper volume 72 and a smaller lower volume 73. A float means 74 including a passageway 76 as described hereinabove is freely received within the upper volume 72 of the container 71. At least a portion of the lower volume 73 communicating with the upper volume 72 is provided with internal dimensions adapted to receive the maximum cross-sectional dimensions of the candle 10 with a close sliding fit. For example, a portion of the side wall 77 of the lower volume 73 may be curved inwardly to provide a stabilizing means 78 for the candle 10 when received in the passageway 76 of the float means 74.

In addition, the lower portion of the upper volume 72 is provided with internal dimensions adapted to receive the cross-section of the float 74 with a close sliding fit as by means of inwardly projecting ribs 75 similar to the ribs 57 of embodiment 50. For clarity of illustration, the water level and float 74 are shown slightly higher than is preferred. At the preferred initial water level the lower end of the float would be received by the ribs 75.

As the candle 10 is consumed by burning, the volume of the candle received in the lower portion 73 of the container 71 will decrease. At the same time the level of the water 12 in the upper volume 72 of the container 71 will decrease. Thus the float means 74 will move downwardly in the container 71 as the candle 10 is consumed. The position of the flame of the candle 10 will remain constant with respect to the level of the water 12 and the float means 74. By proper selection of the relative volumes of the upper portion 72 and lower portion 73 of the container 71, the lower end of the candle 10 will always be received within the stabilizing means 78 provided by the inwardly curved side walls 77 of the container 71 until the length of the candle 10 has been reduced to about the length of the passageway 76 of the float means 74 when the stabilizing means 78 will no longer be required.

The container 71 is made of transparent material such as glass or plastic thus providing a chimney means for the candle 10 to protect the flame thereof from air currents. The shape of the side walls of the upper portion 72 of the container 71 may be selected so that the relative position of the flame of the candle 10 with respect thereto will not be subjected to objectionable diffraction regardless of the axial postion of the flame of the candle 10 with respect to the axial length of the upper portion 72 of the container 71.

Referring to FIG. 8, a candle 80, the flame of which may be caused to repeatedly traverse a given relatively narrow positional range with respect to the surface of the water by a float means according to the teaching of this invention is shown. The candle 80 has an internal construction of the commercially available "dripless" candles mentioned above. Thus, as shown in FIGS. 8 and 9, the candle 80 includes a central wax stem 81 containing the wick and a spaced outer wax sheath 82. A plurality of radial vanes 84 interconnecting the stem 81 and sheath 82 extend longitudinally of the length of the candle defining longitudinal openings through the length of the candle 80. The bottom end of the candle 80 is sealed by melting the wax of the stem 81, sheath 82 and vanes 84 together to form a plug 85. Thus the candle 80 will have an unusually low specific gravity and will tend to float at an elevated position with respect to the surface of the water as discussed hereinabove.

According to this embodiment of the invention, the candle 80 is provided with a plurality of equally spaced wax collars 86 about the external surface of the sheath 82. In addition, an inwardly projecting lip 88 is provided about the upper end of the passageway 16 of the float means 14. Thus the passageway 16 is dimensioned to receive the collars 86 on the external surface of the sheath 82 of the candle 80 with a close sliding fit which is obstructed by contact between the wax collars 86 and the lip 88. Thus when the float means 14 and candle 80 are received in water, the candle 80 will be restrained against upward movement through the passageway 16 by the abutment of the collars 86 against the lip 88. However, as the candle 80 burns, the wax collars 86 will be melted, together with the sheath, allowing the candle 80 to move upwardly until the next collar 86 is brought into abutment with the lip 88. Thus the flame at the end of the candle 80 will repeatedly traverse a restricted positional range with respect to the float means 14 and surface of the water 12.

It is believed that those skilled in the art will make obvious modifications in the various embodiments of this invention as shown in the drawing and described hereinabove without departing from the scope of the following claims. For example, tapered candles conventional in the art may be substituted for the right circular cylindrical candles shown in the drawing particularly in embodiments 40, 50, 60 and 70, as shown in FIGS. 4–7, so long as the passageway in the float member has sufficient axial length to prevent excessive initial tipping of the tapered candle therein. Similarly, embodiments 40, 50, 60 and 70 could be provided with an appropriate fixed or detachable hood or shade as is well known in the art.

What is claimed is:

1. The combination for holding a candle having a specific gravity less than unity with given cross-sectional dimensions and a length which is at least twice as great as said given cross-sectional dimensions; comprising float means including a passageway dimensioned to receive said cross-sectional dimensions of said candle with a close sliding fit and having an axial length of at least about one inch; a container of water for freely receiving said float means with said candle in said passageway; and stabilizing means beneath the surface of said water within said container for maintaining said axial length of said passageway in a substantially vertical position with the upper end of said passageway at the surface of said water in said container when said candle is received in said passageway.

2. The combination of claim 1 wherein said stabilizing means comprises a body having a specific gravity substantially greater than unity and means affixing said body to said float means symmetrically of said axial length of said passageway.

3. The combination of claim 2 wherein said float means comprises a solid body of water-insoluble material having a specific gravity less than unity with said passageway formed therein.

4. The combination of claim 1 wherein said float means comprises an open-ended tubular member defining said passageway with an annular body having a specific gravity less than unity surrounding said tubular member.

5. The combination of claim 4 wherein said tubular member and said annular body comprise thin air-impervious walls defining a hollow air-filled annulus.

6. The combination of claim 4 wherein said stabilizing means comprises an extension of said tubular member having a specific gravity substantially greater than unity.

7. The combination of claim 6 wherein said float means includes a hollow, tubular, transparent chimney member surrounding the opposite end of said tubular member from said extension thereof and projecting from said float means coaxially of said tubular member.

8. The combination of claim 7 wherein the free end of said extension of said tubular member is closed and a small hole is provided through the side wall thereof at said free end thereof.

9. The combination of claim 8 wherein said stabilizing means further comprises a collar of metal surrounding and affixed to the free end of said extension of said tubular member.

10. The combination of claim 8 wherein said container of water has a volume which is a small multiple of the total volume of said candle and said float means and wherein said stabilizing means further comprises means on the inner surface of said container for receiving the free end of said extension of said tubular member with a close sliding fit.

11. The combination of claim 4 further including an auxiliary float means comprising a body having a specific gravity less than the specific gravity of said candle received in said free end of said extension of said tubular member with a sliding fit.

12. The improved combination comprising (a) a candle having a specific gravity less than unity with given cross-sectional dimensions and a length which is at least a small multiple of said given cross-sectional dimensions;

(b) a container open at its top end made of water-impervious material transparent to a given range of light having internal cross-sectional dimensions greater than said cross-sectional dimensions of said candle with a volume which is at least about three times and not more than about ten times the volume of said candle and a depth substantially greater than the length of said candle, filled with water to a depth at least equal to the length of said candle, said container being divided into an upper volume of given size having a depth substantially greater than one inch and a lower volume of smaller size with a passageway communicating therebetween, said passageway being dimensioned to receive said cross-sectional dimensions of said candle with a close sliding fit; and (c) a float means freely received in said upper volume of said container, said float means including a passage dimensioned to receive said cross-sectional dimensions of said candle with a close sliding fit and having an axial length of at least about one inch and substantially less than the depth of said upper volume.

13. In the combination of a water filled vertical container of given depth open at its top end and a candle having a specific gravity less than unity with given maximum cross-sectional dimensions and axial length less than said given depth of said container and at least twice said given maximum cross-sectional dimensions axially received in a candle guide within said container with a close sliding fit, the improvement wherein said candle guide comprises a float member including a passageway with an axial length of at least about one inch dimensioned to receive said given maximum cross-sectional dimensions of said candle with a close sliding fit, said float member also including stabilizing means for maintaining said axial length of said passageway in a substantially vertical position with the upper end thereof at the surface of said water in said container.

14. The improvement of claim 13 wherein said float member comprises a body having a specific gravity less than unity and an elongated tubular member having a specific gravity greater than unity extending therethrough with a portion projecting from one side thereof to a free end, said elongated tubular member defining said passageway, and said stabilizing means comprising said projecting portion of said elongated tubular member.

15. The improvement of claim 14 wherein said stabilizing means further comprises a body having a specific gravity greater than unity mounted on said free end of said portion of said elongated tube projecting from said one side of said body.

16. The improvement of claim 14 further including an auxiliary float body having a specific gravity less than said specific gravity of said candle received with a sliding fit in said free end of said portion of said elongated tubular member projecting from said one side of said body.

17. The improvement of claim 13 wherein said float member includes a hollow open-sided tubular chimney member projecting coaxially of said passageway and having cross-sectional dimensions substantially greater than said given maximum cross-sectional dimensions of said candle.

18. The improvement of claim 13 wherein said float member comprises a body having a specific gravity less than unity surrounding said passageway with a member having a specific gravity greater than unity attached to said body symmetrically of one end of said passageway providing said stabilizing means.

19. The improvement of claim 13 wherein said float member comprises a hollow-air-filled annulus surrounding said passageway.

20. The improvement of claim 14 wherein said portion of said elongated tubular member projecting from said one side of said body is closed at the end thereof remote from said body and has a restricted hole through the side wall thereof at said closed end.

21. The improvement of claim 13 wherein said candle has a longitudinally extending passageway therethrough which is closed at one end of said candle.

22. The improvement of claim 13 including a stop means at said upper end of said passageway for preventing the passage of said maximum cross-sectional dimensions of said candle.

* * * * *